United States Patent [19]

Anderson

[11] Patent Number: 4,799,725

[45] Date of Patent: Jan. 24, 1989

[54] GOLF BALL RETRIEVER

[75] Inventor: Alf Anderson, Brooklyn Park, Minn.

[73] Assignee: Surelab Superior Research Laboratories, Inc. St. Paul, Minn.

[21] Appl. No.: 113,252

[22] Filed: Oct. 16, 1987

[51] Int. Cl.[4] ..... A63B 47/02

[52] U.S. Cl. ..... 294/19.2; 56/400.11; 294/55

[58] Field of Search ..... 294/1.4, 1.5, 19.1, 294/19.2, 55, 66.1; 15/1.7, 257.1, 257.4; 37/55, 118 R, 119, 120, 137; 43/7, 11, 12; 56/328.1, 332, 400.01, 400.11, 400.12; 248/95, 99–101; 273/32 F, 162 E; 210/470, 471

[56] References Cited

U.S. PATENT DOCUMENTS

| | | | |
|---|---|---|---|
| 1,659,482 | 2/1928 | Dennemark | 294/19.2 |
| 1,723,709 | 6/1929 | Reiser | 294/19.2 |
| 1,782,497 | 11/1930 | Anderson | 37/119 |
| 3,141,696 | 7/1964 | Nau | 294/19.2 |
| 3,276,807 | 10/1966 | Ward | 294/19.2 X |
| 3,394,483 | 7/1968 | Taglioli | 37/119 X |
| 3,663,049 | 5/1972 | James | 294/19.2 |
| 3,754,785 | 8/1973 | Anderson | 294/55 X |
| 3,926,464 | 12/1975 | Alexander | 294/19.2 |
| 3,979,146 | 9/1976 | Berg | 294/55 |
| 4,509,751 | 4/1985 | Tabet | 294/19.2 X |

FOREIGN PATENT DOCUMENTS

| | | | |
|---|---|---|---|
| 2239197 | 2/1975 | France | 37/119 |
| 1330498 | 9/1973 | United Kingdom | 43/11 |

*Primary Examiner*—Johnny D. Cherry
*Attorney, Agent, or Firm*—James R. Haller

[57] ABSTRACT

The present invention relates to a golf ball retrieving device for removing golf balls from water hazards and other areas that otherwise would be difficult to access. The device comprises a uniquely shaped net particularly adapted to be removably attached to an end of an existing ball retriever having an extendable shaft. The net and frame are configured and arranged so as to easily retrieve golf balls from water hazards even when the golf ball is not in plain view. The device effectively sweeps a substantial portion of terrain as it is retracted toward the user enabling the user to retrieve golf balls that are contained in that area. The frame is configured to discourage weeds from entering and obstructing the net.

6 Claims, 2 Drawing Sheets

GOLF BALL RETRIEVER

FIELD OF THE INVENTION

The invention relates to devices for retrieving golf balls from hard-to-reach locations, and more particularly to golf ball retrieving devices for removing golf balls from waterholes where the balls may be difficult to see.

BACKGROUND OF THE INVENTION

Golf ball retrievers are generally adaptable for retrieving golf balls from water hazards in which the golf balls are visible. The water must be relatively clear and free of weeds, and the balls must be at rather shallow depths. A golfer must guide a golf ball retriever so as to scoop the golf ball in the cup of the device with extreme care and precise manipulation of the handle to prevent the ball from becoming covered by silt and debris or lost among sub-surface terrain. Golf balls become very difficult to see in many waterholes at depths in excess of approximately five feet. A golfer must also deal with light refraction which makes it difficult to judge the distance and position of the golf ball from the player when the ball is under water.

U.S. Pat. No. 1,659,482 discloses a device comprising a circular hoop of wire extending from a hollow extendable handle, the hoop containing a net wrapped about its periphery for receiving and retaining golf balls. U.S. Pat. No. 4,509,751 discloses a combination golf ball retriever and wind indicator comprising a circular hoop containing a net which is attached to the end of an extendable pole, by a swivel enabling the net to rotate freely about the axis of the pole. Both of these devices have nets that are relatively small and that require the user to have a golf ball in sight in order to remove it from a water hazard.

It would be desirable to have a device for retrieving, from a water hazard, golf balls that are not in plain view but that are known by a golfer to be in a general area.

SUMMARY OF THE INVENTION

The present invention provides a golf ball retrieving device for removing golf balls and other objects from water hazards and other hard to reach places. The device comprises a generally stiff metal wire frame, a net attached to the frame about its periphery and shaped to billow out from the frame, and attachment means enabling the device to be removably but rigidly attached to the shaft of a pole. The frame desirably includes an elongated first, straight side, two short second sides extending respectively from ends of the first side and defining therewith a first plane, and two third sides extending from ends of the second sides and lying in a plane at an obtuse included angle to the first plane, the third sides converging toward said attachment means.

DETAILED DESCRIPTION OF THE PREFERRED EMBODIMENTS

Figure 1:
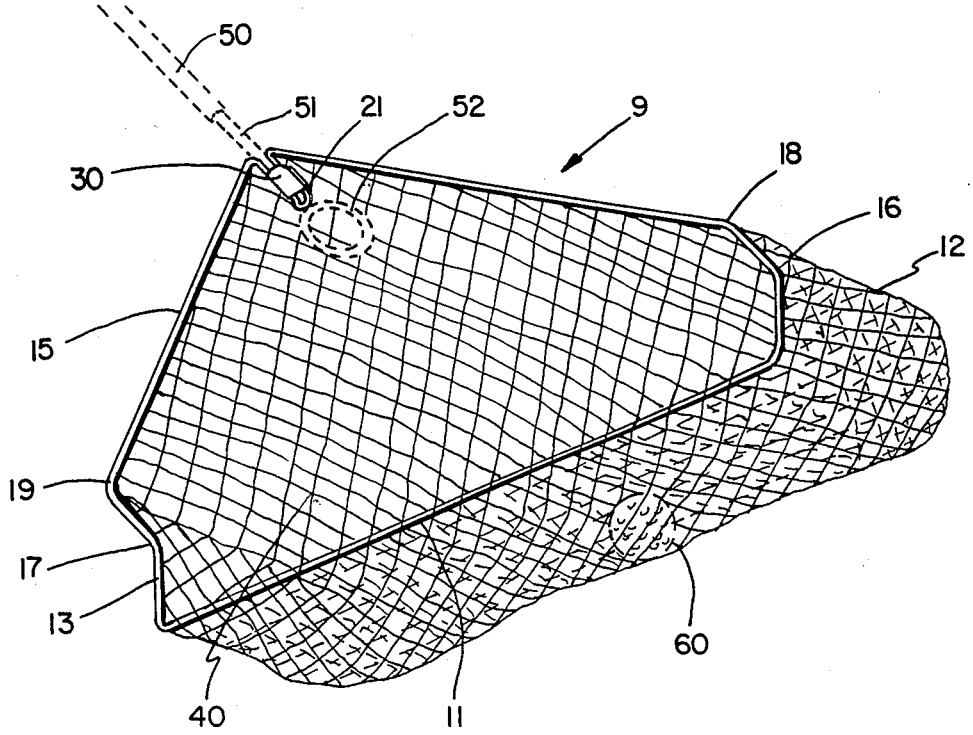
FIG. 1 is a perspective view of the golf ball retriever of the invention.

Referring to the drawings, a golf ball retriever is shown as (9) in FIG. 1. The golf ball retriever (9) comprises a generally clothes hanger-shaped frame (10) with an elongated first straight side (11) and two short second sides (12, 13) carried by ends of the first side (11) on opposite ends thereof and defining a first plane, the two short second sides (12, 13) being generally perpendicular to the first side (11) and desirably generally parallel to each other. Two angled third sides (14, 15) are carried at the ends of the two short sides (12, 13) and extend convergently to the attachment means (20) to define a plane lying at an obtuse angle with respect to the first plane. The third sides (14, 15) are angled at an acute angle with respect to the first side (11). This configuration allows the device to be dragged through aquatic weeds without capturing a significant amount of weeds. The angled sides (14, 15) tend to part weeds and aquatic growth and direct the same laterally away from the net (40). The elongated straight side (11) is thin so as to closely contact the floor of a water hazard when the device is dragged through it, allowing the straight side (11) to pass between any golf balls (60) or objects and the floor of the hazard in order to capture the balls (60) in the net. Elbows (16, 17) are found between each short second side (12, 13) and its adjacent third side (14, 15), making the second and third sides meet at preferably an approximate 110 degree angle. The planes defined, respectively, by the second and third pairs of sides, lie at an included angle of about 110° to enable the elongated straight side (11) to be carried below the axis 53 of the pole 50. The third sides (14, 15) may contain bends (18, 19) enabling the frame (10) to encompass a greater area through which the golf balls (60) may enter the net (40). The frame (10) is preferably about eighteen inches by six inches in overall dimension to easily fit into a golf bag. The frame (11) is preferably comprised of a stiff metal wire.

Connecting the converged, terminating ends of the two angled sides (14, 15) is an attachment means (20) enabling the device to be removably attached to the shaft (51) of a pole (50). The attachment means (20) preferably comprises a "U" shaped channel (21) for reception of a shaft (51) of a golf ball retriever pole (50). The attachment means (20) enables the device to be rigidly attached to the shaft (51) of a golf ball retriever pole (50), at a position spaced a distance from its end, so that the device may be dragged through a water hazard to retrieve golf balls (60). This configuration allows the device to be attached to the shaft of a golf club or a golf ball retriever so that the head of the golf club or retriever (52) does not interfere with the operation of the device.

The channel (21) is attached to the frame (10) of the device by means of two parallel, spaced apart portions adjacent the angled sides (14, 15) of the frame (10) which are welded or otherwise suitably attached to the sides (22) of the channel (21). The channel (21) is located and arranged on the device to enable the device to protrude beyond the end of a pole (50), facilitating use of the device in retrieving golf balls. The channel (21) is sized to receive and retain poles (50) having a ⅜" diameter shaft (51). Smaller diameter shafts (51) may be enlarged by wrapping tape around the shaft (51) to size them to be firmly received by the channel (21)

Carried upon the outer surface of the channel (21) is a retaining clip (30) which is preferably "C" shaped to grippingly engage the edges of the channel (21) to retain the shaft (51) of a golf ball retriever pole (50) within the channel (21). The retaining clip (30) includes a tab (31) extending from one end thereof to enable the clip (30) to be gripped, facilitating removal and application of the clip (30) to the sides of the channel (21). The retaining clip (30) may be hingedly attached to one edge of the channel (21), enabling the clip (30) to be rotated into and out of engagement with the opposite edge of the channel (21). Alternatively, the clip (30) may include a protrusion through which a cord may be attached to secure the clip (30) to the device so that the clip (30) will not be misplaced. The attachment means (20), as thus typified, firmly attaches the device of the invention to the shaft (51) of the golf ball retriever pole (50) to restrain movement of the device transversely of the pole axis (53). Preferably the end of the channel (21) contains a raised portion of the frame (10) to prevent the retaining means (30) from sliding off the channel (21).

Figure 4:
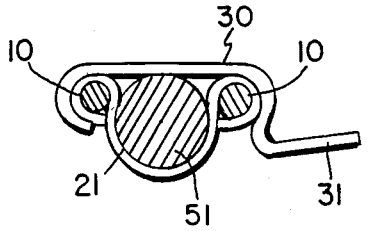
FIG. 4 is a cross-sectional view of the attachment means taken along line 4—4 of FIG. 2.
Figure 2:
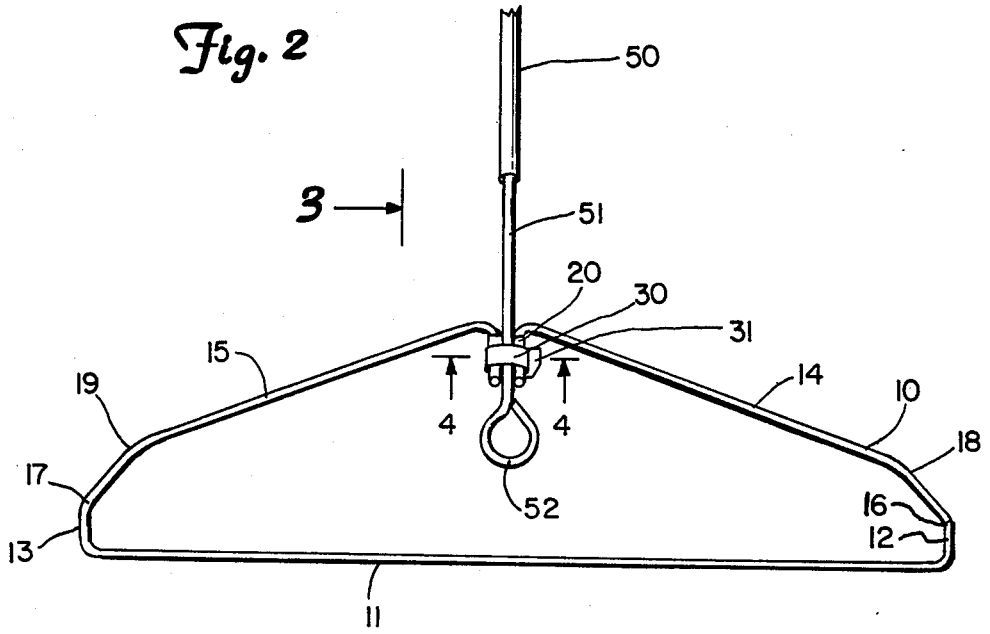
FIG. 2 is a front view of the golf ball retriever of the invention.
Figure 3:
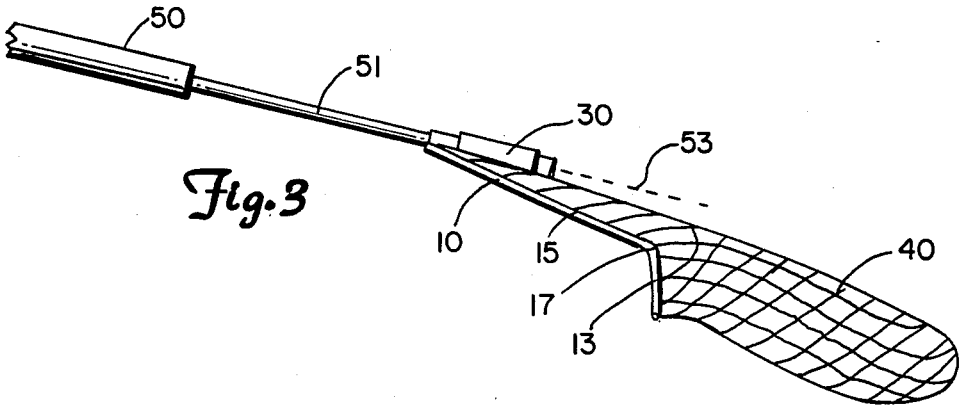
FIG. 3 is a side view of the golf ball retriever of the invention.

In order to operate the device of the invention, the retaining clip (30) is removed from its engagement with the sides of the channel (21). Next, the shaft (51) of a golf ball retriever pole (50) is placed within the channel (21) with its ball holding apparatus extending beyond the channel (21) a short distance. The retaining clip (30) is then snapped over the edges of the channel (21) as shown in FIG. 4. The golf ball retriever is then ready for use. The retaining clip (30) prevents the device from disengaging the pole shaft (51) and becoming lost in a water hazard. To use the assembled device, the handle of the pole (50) is firmly gripped while the device is extended over a water hazard with the elongated straight side (11) of the net frame (10) below the pole (50) and generally horizontal. The device may be entered into the water linearly beyond the point where the golf ball is expected to be resting. After the device sinks to the bottom of the pond, the pole is retracted toward the user, thus sweeping out an area directly in front of the user, the net billowing outwardly behind the frame. After pulling the device a distance along the floor of the pond, the device may be raised from the water and the net checked for golf balls or debris. The net is effective in sweeping out generally linearly directed strips of pond floor even in places where the user has not seen a ball go directly into the pond. If the user move the device laterally to the side a short distance for each strip, he can effectively sweep out a substantial portion of a pond floor, thus removing any balls contained in that area.

The elongated straight side (11) and the two second, short sides (12, 13) of the frame (10) form a first plane which is carried at an obtuse angle with respect to the axis (53) of the pole (50), this plane forming a portion of the golf ball retrieving opening that remains open when the device is pulled generally in the direction of the axis (53) of the pole (50). The second plane defined by the converging third sides (14, 15) of the frame is desirably parallel to, and preferably coextensive with, the axis (53) of the pole (50).

The pole used with this invention may be the pole of another golf ball retrieving device, such as a telescopically extendable pole with a circular, ball capturing ring carried by an end. The device of the invention may alternatively be attached to the shaft of a golf club near the club head. A plain pole may also be used.

While a preferred embodiment of the present invention has been described, it should be understood that various changes, adaptations and modifications may be made therein without departing from the spirit of the invention and the scope of the appended claims.

What is claimed is:

1. A golf ball retrieving device for attachment to the shaft of a pole at a position spaced from an end thereof comprising a generally stiff frame defining an enclosed three-dimensional figure, the frame having a long straight horizontal side, two upright sides extending generally perpendicular from the horizontal side, and forming therewith a first plane, two converging sides extending from the upright sides and defining a second plane, the first and second planes intersecting each other at an obtuse included angle, attachment means carried by the frame for removably attaching the device to the shaft of a pole at a position spaced from its end, and a net attached to said frame for receiving and retaining golf balls.

2. The golf ball retreiving device of claim 1 wherein the overall length of the frame is at least twice as large as the overall width of the frame, the device being sized to fit easily into a storage compartment of a golf bag.

3. The device of claim 2 in which the overall length and width of the device are approximately 18 inches and 6 inches, respectively.

4. The golf ball retrieving device of claim 1 wherein the net is a soft, deformable mesh and is attached continuously about the frame, the net being suitably sized to billow outwardly from the frame creating a pouch for receiving and retaining golf balls, the mesh of the net being large enough to prevent accumulation of water and small debris and small enough to retain the golf balls.

5. The device of claim 1 including retaining means for securely and removably retaining the attachment means on the shaft of the pole to restrain movement of the frame with respect to the pole.

6. A golf ball retrieving device comprising a golf ball retriever pole bearing a ball-holding apparatus at its end; and as generally stiff frame defining an enclosed 3-dimensional figure, the frame having a long straight horizontal side, two upright sides extending generally perpendicular from the horizontal side and forming therewith a first plane, and two converging sides extending from the upright sides and defining a second plane, the first and second planes intersecting at an obtuse included angle, attachment means carried by the frame for removably attaching the frame to the golf ball retriever pole at a position spaced from its end, said attachment means including means defining a U-shaped channel for reception of the retriever pole with the ball-holding apparatus extending beyond the channel.

* * * * *